US005472391A

United States Patent [19]

Weissbuch

[11] Patent Number: 5,472,391

[45] Date of Patent: Dec. 5, 1995

[54] AQUATIC EXERCISE DEVICE WITH AUXILIARY BUOYANT ELEMENTS

[76] Inventor: Sanford S. Weissbuch, 2276 S. Beverly Glen Blvd., Beverly Hills, Calif. 90064

[21] Appl. No.: 175,117

[22] Filed: Dec. 29, 1993

Related U.S. Application Data

[63] Continuation-in-part of Ser. No. 81,166, Jun. 25, 1993, Pat. No. 5,385,521.

[51] Int. Cl.[6] ..... A63B 31/00

[52] U.S. Cl. ..... 482/55; 482/111; 434/254; 441/106; 441/114

[58] Field of Search ..... 482/55, 105, 111; 434/254; 441/56, 58, 160, 65, 88, 106, 108, 111, 114, 115, 117, 119, 125, 129, 136; 472/128, 129; D21/228, 236–239; 128/869, 870; 602/19

[56] References Cited

U.S. PATENT DOCUMENTS

| | | |
|---|---|---|
| D. 187,764 | 4/1960 | Rodriguez . |
| D. 195,384 | 6/1963 | Del Mar . |
| D. 197,820 | 3/1964 | Baker . |
| D. 265,116 | 6/1982 | Churchill . |
| D. 315,010 | 2/1991 | Stevens . |
| D. 319,485 | 8/1991 | Scheurer . |
| D. 320,059 | 9/1991 | Bedortha et al. . |
| D. 323,541 | 1/1992 | Ciolino . |
| D. 329,633 | 9/1992 | Rogers . |
| 676,359 | 6/1901 | Gair . |
| 727,444 | 5/1903 | Recordon . |
| 803,910 | 11/1905 | Ledermann . |
| 1,446,099 | 2/1923 | Marks . |
| 1,478,239 | 12/1923 | Marengo et al. . |
| 1,506,359 | 8/1924 | Bower . |
| 1,538,627 | 5/1925 | DiLauro . |
| 1,617,061 | 2/1927 | La Pierre . |
| 1,713,733 | 5/1929 | Anderson . |
| 2,802,222 | 8/1957 | Chapman . |
| 2,889,830 | 6/1959 | Raymond . |
| 2,898,610 | 8/1959 | Chamberlain . |
| 2,935,751 | 5/1960 | Emmick et al. . |
| 2,940,453 | 6/1960 | Lerner . |
| 3,049,735 | 8/1962 | Baker . |
| 3,077,618 | 2/1963 | O'Link . |
| 3,094,725 | 6/1963 | Martin, Jr. . |
| 3,101,492 | 8/1963 | Martin . |
| 3,134,995 | 4/1961 | Kirchner . |
| 3,137,015 | 6/1964 | Lindeman . |
| 3,183,530 | 5/1965 | Girden . |
| 3,416,172 | 12/1968 | Gerling . |
| 3,425,072 | 2/1969 | Carlson . |
| 3,427,020 | 2/1969 | Montour et al. . |
| 3,547,165 | 10/1985 | Scheurer et al. . |

(List continued on next page.)

*Primary Examiner*—Richard J. Apley
*Assistant Examiner*—Jeanne M. Clark
*Attorney, Agent, or Firm*—Merchant, Gould, Smith, Edell, Welter & Schmidt

[57] ABSTRACT

An aquatic exercise device which has a dual configuration of (1) a hand-held buoyancy swimming kickboard; and (2) a buoyancy device worn around the human's midsection. The device is a buoyant board element which is substantially elongated, of greater length than width, and having large surface areas at opposite sides thereof. Affixed to and/or projecting from the buoyant board element are opposing limbs of band elements. When secured around the human midsection, the device is used in deep water to support the human in a relatively or substantially vertical position. This allows upright exercise while the human is freely suspended with the head and most or all of the neck above water, and the lower extremities bearing no weight, feet not touching bottom. When the band is folded and/or wrapped and fastened around the board or removed, the board can be used as a kickboard. An auxilliary buoyant element is provided for location in different selective positions relative to the band and/or board. When used as a swimming kickboard the buoyant element is affixed adjacent to the board. When used about the human's midsection, the auxiliary element is removed from the board and placed adjacent the human torso by affixation with the band.

25 Claims, 4 Drawing Sheets

U.S. PATENT DOCUMENTS

| | | | |
|---|---|---|---|
| 4,123,814 | 11/1978 | Ettinger . | |
| 4,300,759 | 11/1981 | Caplan . | |
| 4,362,518 | 12/1982 | Boissiere . | |
| 4,406,678 | 9/1983 | Rademacher | 434/254 |
| 4,518,364 | 5/1985 | Jacobson | 434/254 |
| 4,575,075 | 3/1986 | Tarbox et al. . | |
| 4,689,030 | 8/1987 | McWaters . | |
| 4,721,300 | 1/1988 | Guzman . | |
| 4,813,668 | 3/1989 | Solloway . | |
| 4,842,562 | 6/1989 | Supal . | |
| 4,905,991 | 3/1990 | Alston . | |
| 4,951,940 | 8/1990 | Vitello et al. . | |
| 4,997,183 | 3/1991 | Winston . | |
| 5,000,710 | 3/1991 | Bedortha et al. . | |
| 5,002,268 | 3/1991 | Anderson | 434/254 |
| 5,092,802 | 3/1992 | Jones . | |
| 5,095,957 | 3/1992 | Herman | 441/117 |
| 5,102,120 | 4/1992 | Lindblad . | |
| 5,152,706 | 10/1992 | Fister | 441/119 |
| 5,169,371 | 12/1992 | Holmes . | |
| 5,176,554 | 1/1993 | Simmons | 441/129 |
| 5,184,993 | 2/1993 | Dowdeswell . | |

AQUATIC EXERCISE DEVICE WITH AUXILIARY BUOYANT ELEMENTS

RELATED APPLICATION

This invention is a continuation-in-part of to Ser. No. 08/081,166 filed Jun. 25, 1993 entitled AQUATIC EXERCISE DEVICE now U.S. Pat. No. 5,385,521. This application incorporates by reference the contents disclosed herein.

BACKGROUND

Having a versatile aquatic exercise device for facilitating upright and horizontal aquatic exercise is valuable.

This invention involves an aquatic exercise device. In particular, the invention is directed to a multi-purpose aquatic exercise device.

Aquatic exercise in the horizontal and upright positions is recognized as an excellent conditioner of the cardiovascular system and body musculature leading to increased endurance, strength, mobility, flexibility and overall physical fitness and sense of well-being while causing little or no stress or trauma upon weight-bearing joints and averting possible injuries associated with land based exercise.

Additionally, aquatic exercise in water less than body temperature allows for rapid dissipation of excess body heat, essentially preventing overheating.

An additional benefit of aquatic exercise is that it can be done in the safety and privacy of a backyard or community swimming pool.

A hand-held upper extremity embraced buoyancy device is a swimming kickboard. This allows the user's upper body to remain stationary, namely resting the upper body, arms and hands and facilitating the raising of the head above water. Exercise can be focused upon the large lower body musculature, utilizing flutter, frog or dolphin kick lower extremity motion. This conditions the cardiovascular system, strengthens the lower extremities and improves kick technique.

Deep water upright exercise buoyancy devices allow the user to exercise and condition the cardiovascular system, upper and lower extremities and most of the remaining body musculature. The user has free use of his upper and lower extremities and thus can for example run, jog, walk or "rock climb" in deep water, not touching bottom. Water provides for resistance to motion in all directions of the submerged body part and resistance increases with more rapid motion.

Deep water upright exercise buoyancy devices are known. These are, however, often poorly fitting, uncomfortable for small or overweight users, and unflattering in appearance when used by overweight users.

These known devices do not provide the additional function of being an effective hand-held buoyancy device, so-called swimming kickboard.

Further, these known devices are not readily adjustable for accommodating larger and/or heavier individual users. Nor do known devices have means whereby a user can selectively incrementally adjust the flotation tilt angle of the body relative to the vertical plane.

Additionally, there are solid flotation devices which are intended as swimming aids. These are positioned posterior to the lumbar and/or thoracic regions of the user's body. These solid devices, however, pose a possible danger to the user because of the tendency of these devices to rise or ride-upward causing the superior end or aspect of the device to lie posterior to the neck/cervical spine region, a relatively vulnerable region of the spinal column. A sudden hyperextension force/whiplash could cause severe damage to the neck/cervical spine due to the fulcrum effect of the upper end or aspect of the solid flotation device.

No presently-known aquatic exercise device effectively serves as a hand-held buoyancy device and a deep water upright exercise buoyancy device.

There is need for such an aquatic exercise device. Such device should be designed to (a) limit the possibility of cervical spine injury;

(b) be easily and securely fastened and quickly removed;

(c) be comfortable and readily adjustable to fit a very wide range of users of variable body habitus;

(d) have favorable appearance characteristics when worn;

(e) be readily adjusted for larger or heavier individuals for total buoyancy;

(f) be readily adjusted such that the tilt angle of the user's body relative to the vertical plane can be selectively and incrementally adjusted by the user.

(g) be simple in construction and assembly, inexpensive to manufacture, easily maintained and rugged and durable in use.

SUMMARY

The present invention provides an aquatic exercise device which seeks to meet the above needs.

According to the invention, an aquatic exercise device comprises a relatively flat and elongated buoyant board element, and a band affixed with the board. The board has opposite surface areas which are relatively large. The band is adapted to releasably secure a flat face of the board adjacent to a human body.

The band is relatively broad such that the width of the band extends at least about 20% of the length of the board. Preferably, the band extends to at least about 25% to about 33% of the length of the board. The band is preferably located in the lower half of the board.

There are means for releasably affixing the band with the board. The band preferably includes at least one free end. The free end includes fastening means whereby the band can be fastened with a mating fastening means selectively on the board or on an opposite free end of the band.

Aperture means permits the band to be threaded through the board thereby affixing the band and board together. The band would act to positively secure the board to the back of a human when the board is strapped to the human.

The board includes a bottom, top, opposite sides and opposite relatively flat or large area surfaces. The apertures, which are at least two slots, are spaced apart and towards the sides of the board. The board can be relatively thicker towards the bottom than towards the top.

Upright aquatic exercise is accomplished by strapping the buoyant board element adjacent to the back of a human. The board is removably affixed on the back. The human would be held in a floating position substantially upright in water. This may be in a range between 0°, and preferably 10° to 30° relative to a vertical position. This allows the user to exercise in the upright position without weight bearing upon the lower extremities.

When the board is not used for upright aquatic exercise, the band can be fastened around the board. Alternatively, the band can be removed from the board. The device can also be used as a hand-held buoyancy device, so-called swimming kickboard.

There is also provided at least one auxiliary buoyant element. The auxiliary buoyant element is removably located relative to the band and/or board such that the auxiliary element can be positioned with the band in a selected position relative to the torso.

Preferably in a first position when the board is used as a kickboard the auxiliary element is located adjacent to the board. In a second position when the board is used as a deep water exercise device the auxiliary element is removed from the board and located with the band in a different position about the torso.

In a preferred form of the invention there are multiple, preferably a pair of auxiliary elements. When the auxiliary elements are located in adjacency with each other and the board they act with the board to form an integral kickboard. The board can include a cut out section for accommodating the auxiliary elements when the board is to be used as a kickboard such that a relatively flat planar or curved planar surface is provided when the auxiliary elements fit within the board cut outs.

When the device is used for upright exercise the auxiliary elements can be removed from their positions adjacent to the board and then be selectively positioned adjacent to the band and relative to the user's torso. The user can thereby selectively adjust the body's tilt angle relative to the vertical plane.

The auxiliary elements, band and board, include fastening means to facilitate locating the auxiliary elements in selected positions relative to the band and board as required.

The invention is further described with reference to the accompanying drawings.

DRAWINGS

Figure 1:
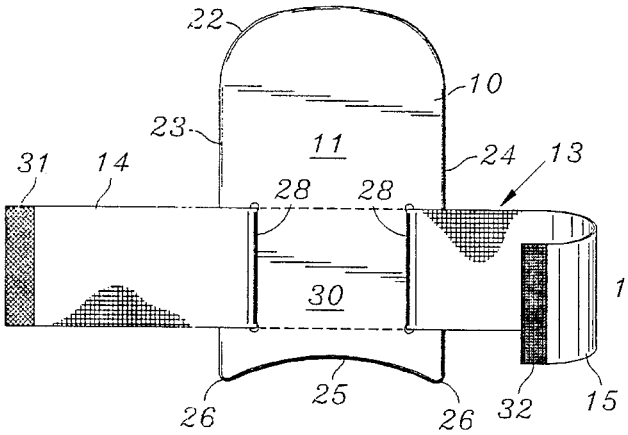
FIG. 1 is a front view of a board with the band intertwined through apertures in the board.
Figure 2:
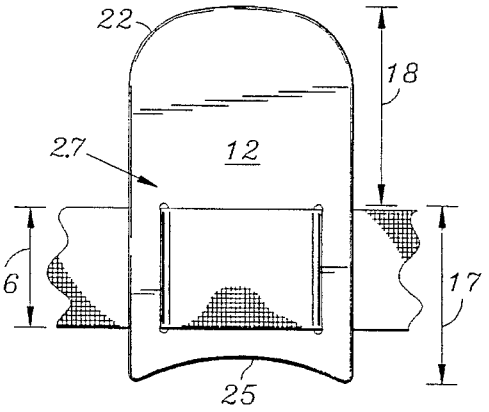
FIG. 2 is a rear view of the board with the band intertwined through the apertures.
Figure 4:
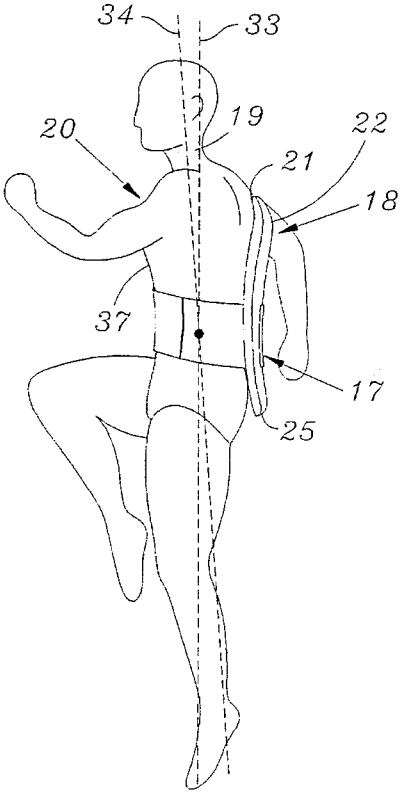
Figure 3:
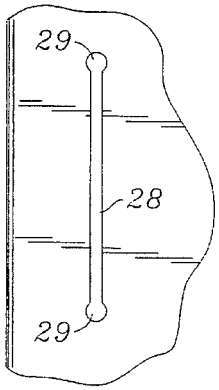
FIG. 3 is a detailed view of the aperture in the board.

FIG. 4 is a view of the device worn by a human with the band affixed around the waist of the human. The board is held in close contact to the user's posterior body torso, namely the back of the user. The board has slightly curved surfaces.

Figure 5:
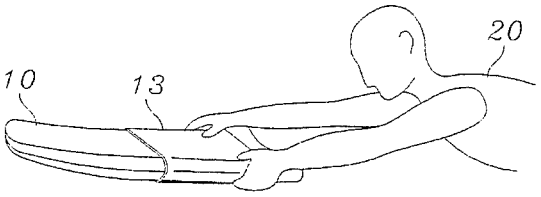

FIG. 5 is a view of the board with the band wrapped and/or folded and fastened around the buoyant board element for hand-held buoyancy, as a swimming kickboard. The board has relatively flat surfaces.

Figure 6:
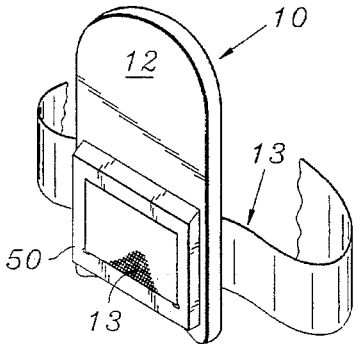

FIG. 6 is a view of the board and band with an auxiliary buoyancy block or plate.

Figure 6A:
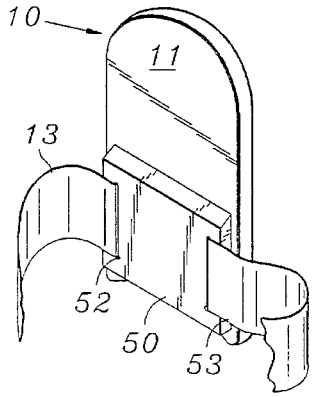

FIG. 6A is a view of the board and band with the auxiliary block in a different position on the board.

Figure 6B:
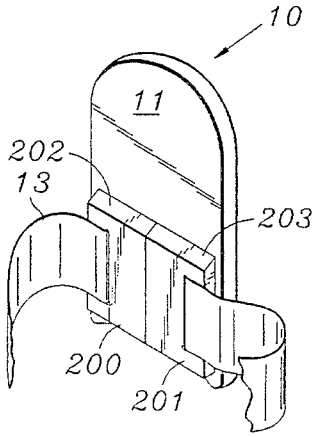

FIG. 6B is a view of the board and band with a pair of auxiliary blocks in a different position on the board.

Figure 7:
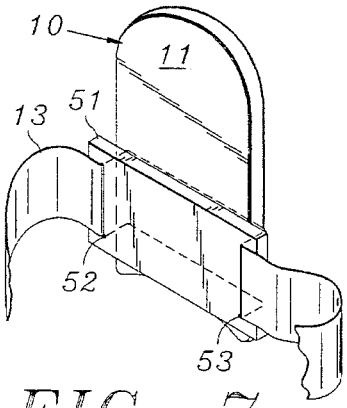

FIG. 7 is a view of the board and band with a different embodiment of the auxiliary buoyancy block or plate.

Figure 8:
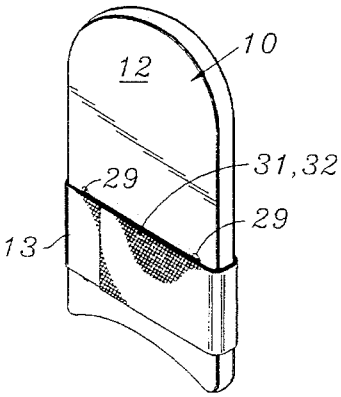

FIG. 8 is a detailed view with the band wrapped around the buoyant board and fastened with a hook and pile mechanical adhesive such as Velcro™.

Figure 9:
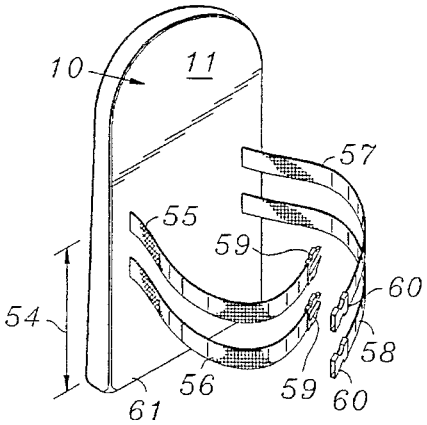

FIG. 9 is a view of a different board and different band means.

Figure 10:
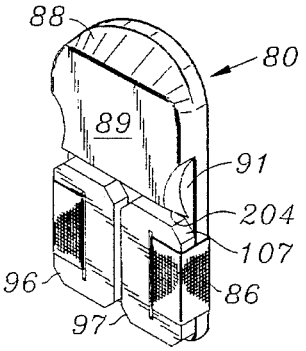

FIG. 10 is a perspective view of the embodiment of the board with the auxiliary buoyant elements located in the cut out in the board.

Figure 11:
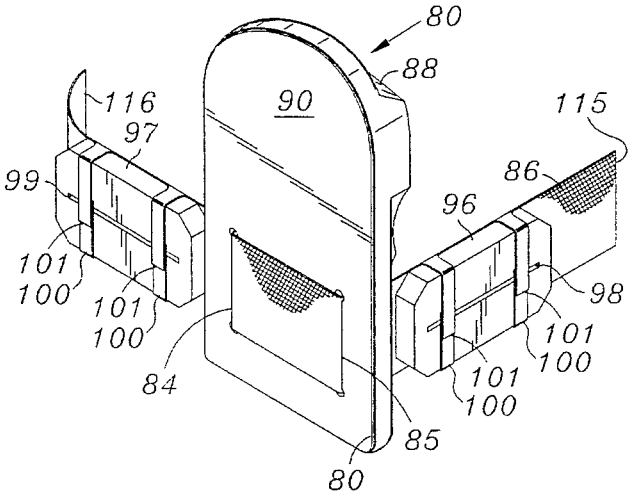

FIG. 11 is a perspective view of the embodiment of the board and auxiliary elements illustrated in FIG. 10 that has the auxiliary buoyant elements attached to the band by straps with hook and pile members and/or elastic loops.

Figure 12:
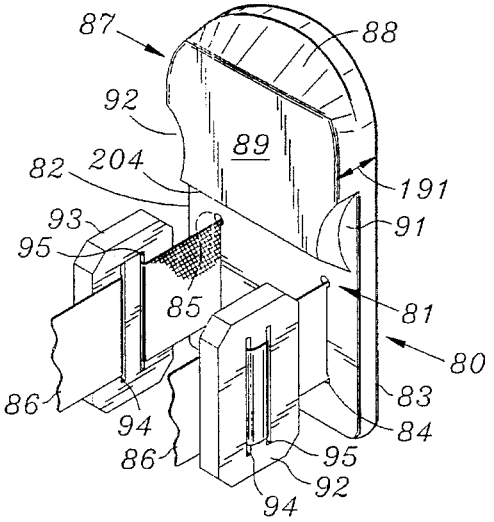

FIG. 12 is a perspective view of a different embodiment of the board having auxiliary buoyant elements attached to the band with a threading engagement.

Figure 13:
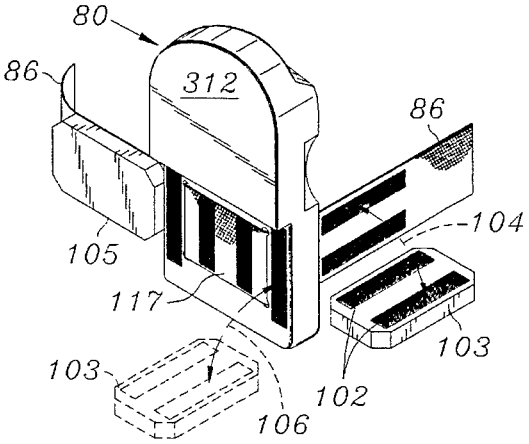

FIG. 13 is a perspective view of a different embodiment of the board with auxiliary buoyant elements shown located with hook and pile members to the band, or with hook and pile members in relation to the board.

Figure 13A:
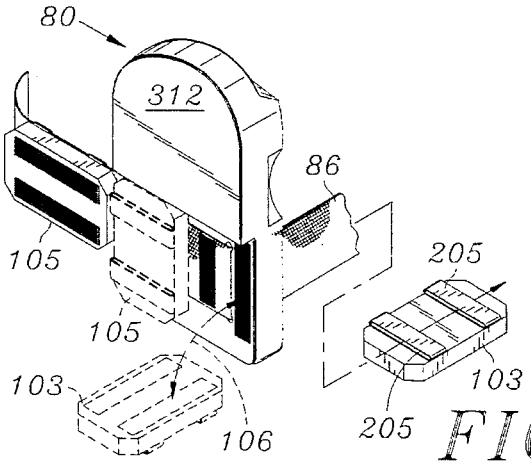

FIG. 13A is a different embodiment of the board, band, and auxiliary elements shown in relation to each other. The auxiliary elements which have elastic loops are located on the band with elastic loops, and then located on the board, hook and pile members effect their location.

Figure 14:
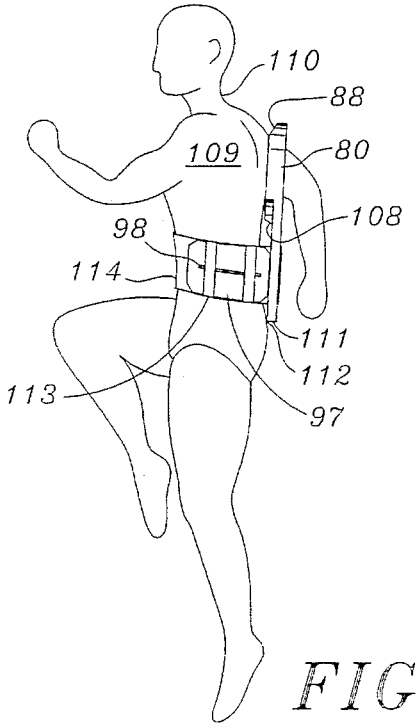

FIG. 14 is a view of the device illustrated in FIG. 11 worn by a human with the band fixed around the waist of the human. The board is held in close contact to the user's posterior body torso, namely the back of the user.

Figure 15:
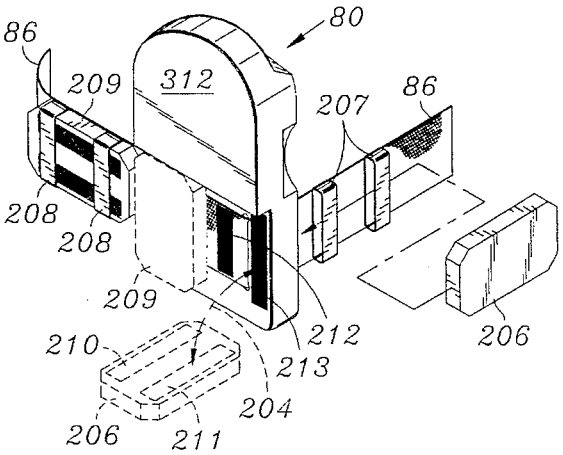

FIG. 15 is an embodiment of the board with the auxiliary buoyant elements located relative to a board with a cut out. Loops are affixed to the band for securing the auxiliary elements with the band. Hook and pile members secure the auxiliary elements with the board.

Figure 16A:
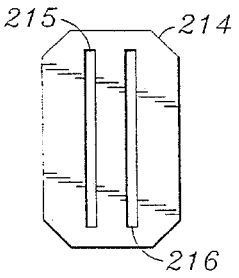

FIG. 16A is a plan view of an auxiliary buoyant element with a pair of spaced slots centrally located in the element.

Figure 16B:
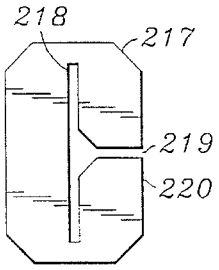

FIG. 16B is a plan view of an auxiliary buoyant element with a central slot and a transverse slot extending from one side to the central slot.

Figure 16C:
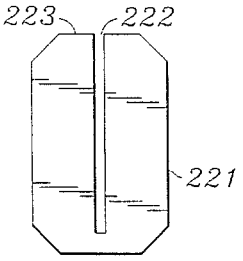

FIG. 16C is a plan view of an auxiliary buoyant element with a central slot extending from one edge and towards but not through the opposite end.

Figure 17:
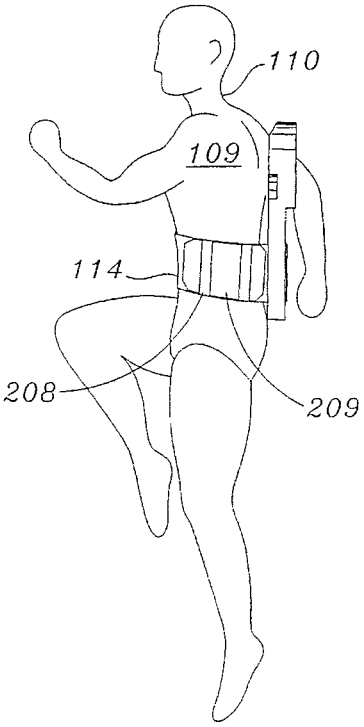

FIG. 17 is a view of the device illustrated in FIG. 15 worn by a human with the band fixed around the waist of the human. The board is held in close contact to the user's posterior body torso, namely the back of the user.

DESCRIPTION

The aquatic exercise device has a dual configuration and dual purpose. Firstly, the device acts as a hand-held buoyancy device, namely as a swimming kickboard.

In a second configuration, the aquatic exercise device is worn around a human body midsection for use in deep water to support the user in a relatively upright position. More specifically, the device supports the user in a substantially or relatively upright position or in a slightly forwardly inclined 0°–30° position. This allows upright exercise while the user's body is freely suspended with the head and most or all of the neck above water. The lower extremities bear no weight, with the feet not touching the bottom.

The aquatic exercise device includes a board 10 of buoyant material. The board 10 is substantially elongated, namely of greater length than width and having relatively large opposite surface areas 11 and 12. These surfaces 11 and 12 may be flat faced or gently curved to facilitate fitting to the back of a user, and/or use as a kickboard.

Affixed to and/or projecting from the buoyant board 10 is a band 13. The band 13 is relatively broad and has opposing limbs 14 and 15. The breadth of the band is about 3" to 10"

in width. The opposing limbs 14 and 15 of the band 13 are located lateral to the board 10 and substantially in the lower half 17 of the buoyant board 10.

Buoyant Board

The buoyant board 10 is constructed of closed cell foam plastic such as Ethylene Vinyl Acetate (EVA) and/or closed cell foam plastic laminate or closed cell foam and non-foam plastic laminate. Such a board is obtainable from Sentinal Water Sports, a division of Packaging Industries Corp. Inc. of 130 North Street, Hyannis, Mass. 02601. EVA is obtainable from the Rubatex Corporation of Bedford, Va. 24523.

The board 10 is substantially flexible in its superior portion 18, such that it may flex or bend away, posteriorly, from a recoiling head/neck 19 of a human user 20. Additionally, the superior edge 21 of the board may be beveled away from the user 20 so that the top of the board is beveled away from the neck 19 of the user.

The mid portion 27 and lower portion 17 of the board 10 are relatively firm or rigid while being somewhat bendable. This assures durability and strength and the stable fixation of the band 13 to the board 10, and user comfort.

The relative flexibility and rigidity of the board 10 is achieved by varying board thickness and/or varying density and other physical properties of board constituents.

The buoyancy may be modified by changes in buoyant board 10 thickness, overall board size, and position of the buoyant board 10 relative to the user 20.

The preferred shape of the buoyant board 10 has a superior aspect which has an outwardly convex curved hydrodynamic shape 22 and to help facilitate superior portion flexibility. Laterally, the board 10 has straight and parallel sides 23 and 24. The bottom 25 of the board 10 is inwardly concave with round corners 26, which increases user comfort when the board 10 is held against the chest 37 of the user 20 when the device is used as a swimming kickboard. The edges are flat along the inferior and lateral aspects and flat or beveled along the upper aspect of the user's side 11 when worn. The thickness of the board 10 which is an integral unit, is substantially uniform and relatively thin compared to the length and board width.

The buoyant board 10 is constructed with two lengthwise elongated narrow, less than about ¼ inch wide, slot-like apertures 28, one on either side of the lower 50%–75% of the board 10. This results in the formation of a single relatively wide central section or strut 30 lying medial to both narrow slots 28. There are two relatively narrow lateral sections to each side of the narrow slots 28. On either end of the elongated narrow slots 28, there is a rounding or a circular expansion aperture 29. These expansion apertures 29 help prevent the narrow slots 28 from enlarging with device use. They also permit escape of any entrapped water or air.

Band

The broad wide band 13 is constructed of durable elasticized and/or non-elasticized materials. The inside of the band 13 which contacts or faces the user's skin may be of a somewhat coarse texture so as to provide additional "purchase". Such a band 13, known as Solar Belt™ is obtainable from Bollinger Industries of 222 West Airport Freeway, Irving, Tex. 75062.

The band 13 is located with, attached to, affixed to, or molded into the buoyant board 10 in any of numerous manners.

The limbs 14 and 15 projecting from buoyant board 10 may originate from one long single band of material or two separate segments or pieces of band material which are:

(1) directly affixed to the buoyant board with glue, staples, mechanically or chemical adhesives; or (2) molded or laminated into the board; or (3) affixed with the aid of slots or apertures of various shapes made within the board. Additionally, the material may be further affixed with glue, staples, mechanically or chemical adhesives; or (4) attached or sewed to loops or other fastening device which emerges from or are attached to the board itself.

These fastening devices or loops may be directly attached to a band, which originate from the board 10 in numerous manners similar to those described above, or which are affixed directly to the board 10.

In the preferred embodiment, the band 13 of elasticized material intertwines or traverses through the elongated narrow slots 28 within the buoyant board 10. The band 13 loops around the single wide central section or strut 30. As such two opposing paired limbs 14 and 15 of the band material project through the elongated slots 28, in front of the board surface 11. The band 13 posteriorly lies flush with surface 12.

The separate broad band 13 of elasticized material may have fabric bonded to at least one side of its surfaces. A Velcro™ or Velcro™-like strip or strips and 32 can be affixed to an end of the side surface opposite the fabric bonded side. The strips 31 and 32 facilitate fastening the band 13 about the waist of the human 20.

Use of Board and Band

The broad band 13 is positioned and snugly wrapped and releasably fastened around the waist and beneath the rib cage of a human 20. This provides stable positioning of the buoyant board 10 in its intended position and alignment, close to the posterior body torso (lumbosacral and thoracic spinal regions and well beneath the neck/cervical region). In this position, the board 10 and band 13 is comfortably located. The device is readily adjustable, and fits a wide range of users of varying body shapes. The device appears waist-trimming and form-flattering in its fit, even to overweight users.

When used with the human 20 vertical, the human can be located along the vertical axis 33 or vary up to about 30° from vertical as shown diagrammatically by line 34. This facilitates aquatic upright exercise such as running and jogging.

When used with the human 20 horizontal, the board 10 can be held ahead of the human 20. The band 13 is wrapped around the board 10. The elasticized characteristics can facilitate that strips 31 and 32 interact to ensure that the band is tightly held about the board 10.

Buoyancy may be adjusted by use of an auxiliary block or plate 50 or 51 of buoyant material, made of similar material as the primary buoyant board 10. The auxiliary buoyant material 50 or 51 may be of various thicknesses and shapes and have slot-like apertures 52 and 53 on each of the two opposing sides. The auxiliary block or plate 50 or 51 of buoyant material may be affixed or held in place close to the primary buoyant board 10 by inserting and passing the limbs of the band 13 through the apertures 52 and 53 on either side of auxiliary block 50 or 51 of buoyant material as illustrated. The auxiliary block 50 or 51 is held adjacent to the lower half of board 10. In FIG. 6, the auxiliary block 50 is adjacent the surface 12. In FIGS. 6A and 7, the auxiliary blocks 50 and 51 are respectively adjacent to the surface 11.

In FIG. 9, a board is shown with a threaded lower portion 54. There are multiple separate spaced body bands 55, 56, 57 and 58. Buckles 59 and 60 interengage and bands 55 to 58 can be adjustable, elasticized or non-elasticized. The ends of the bands 55 to 58 remote from the buckles are affixed with the board 10 by suitable adhesives and/or mechanical affixation as previously described. The bottom 61 is flat.

Different embodiments of the device are illustrated in FIGS. 6A, 6B, 17, and 10 through 15.

In FIG. 6A an embodiment is shown of a board without a cut out and where the auxiliary buoyant element 50 is located adjacent to the front of the board surface 11. The band 13 passes through apertures in the auxiliary buoyant element 50. In FIG. 6B a different embodiment is shown where there are two buoyant elements 200 and 201 which are placed adjacent to the front of the board surface 11. The elements 200 and 201 are placed in adjacency with each other and the top portion 202 and 203 are appropriately beveled.

In FIGS. 10, 11, 12 and 14 the board 80 includes a cut out section 81 in the lower anterior aspect or front 89 of the board 80. The cut out section extends about half the height of the board 80. The cut out also extends from the side 82 to the side 83 of the board. In the lower portion 81 there are two elongated slots 84 and 85 which are longitudinally directed and through which a band 86 is threaded.

At the topmost portion 87 of the board there is a beveled section 88 which tapers away from the surface 89 of the board towards the opposite surface 90 of the board 80. The beveled portion extends from the side 82 to the side 83 of the board 80. Also provided in the surface 89 are two hand cut outs 91 and 92 to facilitate hand-held kickboarding on opposite sides of the board, namely adjacent side 83 and adjacent side 82 of the board 80. The hand cut outs extend for about half the depth of the board as defined by arrow 191. Thus, a hand would grip the board 80 at position 91 when the board is used as a kickboard extended in front of the user. Similarly a hand would grip on the other side of the board 80 in the hand-hold 92. At the bottom of the surface 89 there is also provided a beveled face 204 which is directed to the cut out 81.

As illustrated in FIG. 12 the cut out section 81 can accommodate two auxiliary buoyant elements 92 and 93 respectively. The elements each have two elongated apertures 94 and 95 through which the band 86 can be threaded. This permits securing of the auxiliary elements 92 and 93 with the band 86 as necessary. In the illustration shown in FIG. 12, the auxiliary elements 92 and 93 are located relative to the band 86 and removed from the board 80 and in particular from the cut out 81 of the board 80. In this position the auxiliary buoyant elements could be located to either side, namely in the lateral waist portion of the torso of a human when the device is to be used for upright exercise. Additionally, the elements 92 and 93 can be selectively moved forwardly so as to be located in the anterior portion of the user's torso.

As illustrated in FIG. 11 there is an embodiment where the auxiliary elements 96 and 97 are located with the band 86 in a different manner. As illustrated, the elements 96 and 97 are longitudinally located relative to the band. In this embodiment the elements 96 and 97 have a single longitudinal aperture 98 and 99, respectively. The apertures are used to pass the band 86 through the blocks and locate the blocks adjacent to the board in the cut out. This is when the device is to be used as a kickboard as illustrated in FIG. 10. In the manner illustrated in FIG. 11, the device is set up for use for upright deep water exercising. The slots 98 and 99 are not in use. The elements 96 and 97 are connected with the band 86 through laterally directed straps 100 which have hook and pile means, at least at the ends 101 so that they can be connected together and securely hold the blocks 96 and 97 in position with the band. Alternatively the straps can be replaced with elastic band loops.

As illustrated in FIG. 10 the device of FIG. 11 is set up for use as a kickboard. The elements 96 and 97 are located adjacent to the board 80. The band 86 is wrapped at least in part around the board to ensure that the elements 96 and 97 are securely located in the cut out portion of the board 80. In different situations, the band can wrap completely around the board. The corners of the auxiliary elements are cut off as appropriate. The corner 107 is cut out so that it mates with part of the hand-holding portion 91 when the board and elements are assembled.

In embodiments illustrated in FIGS. 13, 13A, 15 and 17 the paired auxiliary elements fit into a cutout on the lower posterior aspect or back of surface 312 of the board 80.

In FIG. 13 the element 103 is shown removed from the band 86. The arrow 104 indicates how the element 103 can come together to adhere to the band 86. Element 105 is shown adhering to the band 86. In FIG. 13 the element 103 is also shown in phantom removed from the back of the board 80 and arrow 106 shows how these can come together. Element 103 adheres to the back of the board.

As shown in FIG. 14 the device illustrated in FIGS. 10 and 11 is used for deep water exercising. The cut out is shown adjacent to the back 108 of the human 109. The beveled portion 88 faces the neck portion 110 of the human 109. By having this bevel there is less chance of the board 80 impacting with the neck 110 of the human 109. By not having auxiliary elements in the cut out portion in this mode, the board is also helped to be tilted and/or flexed away from the neck 110 since the end 111 can be closer to the lower back and buttock portion 112 of the human 109. The auxiliary element 97 is shown adjacent to the left side waist 113 of the human 109. In another case the element 97 could be put adjacent to the abdomen, namely the anterior torso 114 of the human 109. When element 97 is on the left side waist of the human 109, there is element 96 on the right side.

In the manner illustrated in FIGS. 6B, 17 and 10 through 15 there are a pair of auxiliary elements. In other cases there may be single or multiple elements forming the auxiliary buoyant devices. Different portions of the band 86 can have hook and pile formations at 115 and 116 as required. The back portion 117 of the band 86 may also have the appropriate hook and pile formations. This facilitates a situation where the band 86 can be wrapped around the board 80 or board 10 as respectively illustrated. It is made to engage on itself as appropriate to ensure that in different embodiments the auxiliary element can be securely located with the board.

In FIG. 13A the buoyant elements 103 have strap or loop formations 205 which are spaced apart on the auxiliary buoyant element 103. The band 86 would thread through the straps or loops 205 and thereby secure the element 103 with the strap 86. The block 103 is also shown in phantom in a manner in which it would adhere with hook and pile members to the surface 102 of the board. Likewise an auxiliary block 105 is also shown in phantom adhering to the board. The arrow 106 indicates how the blocks 103 and 105 respectively would adhere to the lower cut out portion of the surface 312.

In FIG. 15 there is illustrated an arrangement where an auxiliary buoyant element 206 fits with the band 86 which is provided with a pair of straps or loops 207 spaced apart on the length of the band 86. On the opposite portion of the band 86 there are also two spaced loops or straps 208. This would be for locating an auxiliary buoyant element 209 to that portion of band 86. The element 206 would also be locatable on the surface 312 of the board 80 by hook and pile means which is provided as two spaced strips 210 and 211 on the one face of the element 206 and complementary strips 212 and 213 on surface 312.

In FIG. 17 the device illustrated in FIG. 15 is shown as worn by the user 109

In FIG. 16A is a plan view of an auxiliary element 214 which has two spaced passages or slots 215 and 216 running longitudinally through the element 214. A band 86 can pass through the slots 215 and 216 and thereby loop connect the band 86 with the buoyant element 214.

In FIG. 16B auxiliary block 217 is shown with a single longitudinal slot 218 and a transverse slot 219 which extends to the side 220 of the buoyant element 217. A band 86 can pass through the slot 219 and then be located in the slot 218. This is one manner of facilitating the interengagement of the band 86 with the buoyant block 217.

In FIG. 16C an arrangement is shown with a buoyant block 221 which has a single longitudinal slot 222 extending in the auxiliary buoyant element 221. This slot 222 extends to the end 223 of the element 221. This facilitates the interengagement of the band 86 with the buoyant element 221.

General

There can be innumerable variations in buoyant board, band and auxiliary blocks or plates. The shape, contour and construction of the board, band and auxiliary block or plates can be changed in a manner which does not depart or substantially change the intended functions of the device.

The elongated buoyant board 10 and 80, for example, may have a top aspect which is straight, pointed, polygonal, or be other shapes. The bottom aspect may be either straight or have other shapes. Surfaces 11 or 89 respectively and 12 or 90 or 312 respectively may be curved inwardly or outwardly. At least one, and preferably both, surfaces 11, or 89, and 12, or 90 or 312 are sufficiently flat to facilitate effective use as a kickboard. The edges may be beveled, faceted, rounded, or have other shapes. The thickness of the board 10 or 80 may vary in different portions. The lateral aspects may be converging/diverging or curved inward or outward. There may be variations in flexibility and rigidity in different portions of the board 10 or 80.

The apertures 28, 84 and 85 along the lateral board aspects, when and if present, may vary in number, shape and course such as converging/diverging.

Notches on the lateral margins of the board 10 or 80, when and if present, may vary in shape and number.

In alternative embodiments of the band 13 or 86, there are multiple opposing limbs of narrower band material which are spaced apart.

Additionally, the band material, may have uniform width. Alternatively the material may be tapered or forked to achieve better fit, comfort and proper positioning. Moreso, the location of the band relative to the board can be changed, for instance, it may be centered about the board or located in some other different position on the board.

In place of hook and pile mechanical adhesive closure elements, buckles such as 59 to 60 or the like can be used to secure the band 13 or 86 about the body, or board.

One or more additional narrower bands may be used to ensure positive location of the upper portion of the board relative to the human when the device is worn by the human for upright aquatic exercise.

While the invention has been described with particularity, it is clear that many changes may be made in the detail of construction without departing from the spirit and scope of the disclosure. It is understood that the invention is not limited to the described embodiments. The scope of the invention is to be determined solely by the following claims.

I claim:

1. An aquatic exercising device comprising:

an elongated buoyant board having an elongated outer surface face being generally planar and said board being without lateral extending flaps and being sized and configured to fit adjacent to the back of a human body, with the outer face of the board generally parallel to the back of the human body, said board having a cut-out in its outer face, band means affixed with the board and at least partially located within the cut-out of the board wherein the band means is adapted to releasably secure the outer surface face of the board generally parallel to the back of the human body, the band means being of a length sufficient that at least together with the board, the band means together with the board is able to surround the torso of the human body with the board being located adjacent to the back of the human body, and at least one auxiliary buoyant element having an outer face including means for permitting removable location of the auxiliary buoyant element relative to the band means such that the auxiliary buoyant element can be removably positioned with the band means in selected positions relative to the torso, wherein the cut-out of the board is sized and configured to receive the auxiliary buoyant element within the outer surface face of the board such that the outer face of the auxiliary buoyant element is continuous with the outer surface face of the board whereby the board outer surface face and the flat face of the auxiliary buoyant element can be located substantially parallel to a water surface for use as a kickboard.

2. A device as claimed in claim 1 wherein the at least one auxiliary buoyant element includes multiple auxiliary elements, the elements being for location in a first position in adjacency with the board and in a second position removed from the board.

3. A device as claimed in claim 1 additionally including means with the auxiliary buoyant element for affixing the auxiliary buoyant element with the band means.

4. A device as claimed in claim 3 wherein both the band means and the auxiliary element includes the means for affixing, the means for affixing including hook and pile means.

5. A device as claimed in claim 1 wherein the band means, board, and auxiliary buoyant element additionally include fastening means for affixing the auxiliary buoyant element in different selective positions with the board and band means.

6. A device as claimed in claim 1 wherein the means for permitting removable location of the auxiliary buoyant element includes an aperture means for the band means to pass through the auxiliary buoyant element.

7. An aquatic device as claimed in claim 1 wherein the band means is relatively broad such that the width of the band means extends at least about 20% of a board length.

8. An aquatic device as claimed in claim 1 including means for releasably affixing the band means with the board.

9. An aquatic device as claimed in claim 1 wherein the band means includes at least one free end, the free end including fastening means whereby the band means is fastenable with a mating fastening means with the board.

10. An aquatic device as claimed in claim 1 wherein the board includes aperture means, the aperture means permitting the band means to be threaded through the board thereby affixing together the band means and board.

11. An aquatic device as claimed in claim 10 wherein the apertures means are elongated slots, the slots being directed along the board length.

12. An aquatic device as claimed in claim 1 wherein the board includes a bottom, top, opposite sides and opposite relatively flat surfaces, one of the surfaces being for location adjacent to the back, and one surface including the means for receiving the auxiliary element, such means for receiving including a cut out for selectively accommodating the auxiliary element, and wherein the surface adjacent to the back includes a top portion beveled away from the flat surface for location on the back thereby to locate the top portion of the board at least partly away from a posterior neck region of the body.

13. An aquatic device as claimed in claim 1 wherein the board includes a bottom, top, opposite sides and opposite relatively flat surfaces, and the band being accommodated on the board essentially within a lower half portion of the board.

14. An aquatic device as claimed in claim 1 wherein the band means includes at least one free end, the free end including fastening means whereby the band means is fastenable with a mating fastening means on an opposite free end of the band means.

15. An aquatic device as claimed in claim 1 wherein the band means is relatively broad such that the width of the band means extends at least 20% of the board length, and wherein the board includes a bottom, top, opposite sides, and opposite relatively flat surfaces, and the band means being accommodated on the board essentially within a lower half portion of the board.

16. An aquatic exercising device comprising:

an elongated buoyant board having an elongated outer surface face being generally planar and said board being without lateral extending flaps and being sized and configured to fit adjacent to the back of a human body, with the outer face of the board generally parallel to the back of the human body, said board having a cut-out in its outer face, band means affixed with the board wherein the band means is adapted to releasably secure the outer surface face of the board generally parallel to the back of the human body, the band means being of a length sufficient that at least together with the board, the band means together with the board is able to surround the torso of the human body with the board being located adjacent to the back of the human body, and at least one auxiliary buoyant element having an outer face including means for permitting removable location of the auxiliary buoyant element relative to the board such that the auxiliary buoyant element in a first position can be located adjacent to the board within the cut-out and in a second position can be located in a position removed from the board, wherein the cut-out of the board is sized and configured to receive the auxiliary buoyant element within the outer surface face of the board such that the outer face of the auxiliary buoyant element is continuous with the outer surface face of the board whereby the board outer surface face and the flat face of the auxiliary buoyant element can be located substantially parallel to a water surface for use as a kickboard.

17. A device as claimed in claim 16 wherein the at least one auxiliary buoyant element includes a pair of auxiliary elements, the elements being for location in a first position in adjacency with the board and in a second position removed from the board.

18. A device as claimed in claim 16 additionally including means with the auxiliary buoyant element for affixing the auxiliary buoyant element with the band means.

19. A device as claimed in claim 18 wherein both the band means and the auxiliary element includes the means for affixing, the means for affixing including hook and pile means.

20. A device as claimed in claim 16 wherein the band means, board, and auxiliary buoyant element additionally include fastening means for affixing the auxiliary buoyant element in different selective positions with the board and band means.

21. A device as claimed in claim 16 wherein the means for permitting removable location of the auxiliary buoyant element includes an aperture means for the band means to pass through the auxiliary buoyant element.

22. An aquatic device as claimed in claim 16 wherein the band means is relatively broad such that the width of the band means extends at least 20% of the board length, and wherein the board includes a bottom, top, opposite sides, and opposite relatively flat surfaces, and the band means being accommodated on the board essentially within a lower half portion of the board.

23. An aquatic exercising device comprising:

an elongated buoyant board having an elongated outer surface face being generally planar, a bottom, a top, opposite sides and a substantially flat surface opposite of the outer surface face, and said board being without lateral extending flaps and being sized and configured to fit adjacent to the back of a human body, with the outer face of the board generally parallel to the back of the human body, said board having a cut-out in its outer face, band means affixed with the board essentially within a lower half portion of the board and at least partially located within the cut-out of the board wherein the band means is adapted to releasably secure the outer surface face of the board generally parallel to the back of the human body, the band means being of a length sufficient that at least together with the board the band means together with the board is able to surround the torso of the human body with the board being located adjacent to the back of the human body, and the band means having a width that extends at least 20% of the board length, and at least one auxiliary buoyant element having an outer face including means for permitting removable location of the auxiliary buoyant element relative to the band means such that the auxiliary buoyant element can be removably positioned with the band means in selected positions relative to the torso, wherein the cut-out of the board is sized and configured to receive the auxiliary buoyant element within the outer surface face of the board such that the outer face of the auxiliary buoyant element is continuous with the outer surface face of the board whereby the board outer surface face and the flat face of the auxiliary buoyant element can be located substantially parallel to a water surface for use as a kickboard.

24. An aquatic exercising device comprising:

an elongated buoyant board element having a relatively flat face, the board being generally planar and being without lateral extending flaps and being sized and configured to fit adjacent to the back of a human body with the flat face of the board generally parallel to the back of the human body, a band means affixed with the board whereby the band means is adapted to releasably secure the flat face of the board adjacent to the back of the human body, the band means being of a length sufficient that at least together with the board, the band means together with the board is able to surround the torso of the body with the board being located adjacent to the back of the human body, and the overall width of the band means extending at least about 20% of a board length, and wherein the band means is located essentially in a lower portion of the board element and not in an upper portion of the board element, and at least one auxiliary buoyant element, the auxiliary buoyant element including means for permitting removable location of the auxiliary buoyant element relative to the band means such that the auxiliary buoyant element can be positioned with the band means in a selected position relative to the torso.

25. An aquatic exercise device comprising:

an elongated buoyant board element having a relatively flat face, the board being generally planar and being without lateral extending flaps and being sized and configured to fit adjacent to the back of a human body with the flat face of the board generally parallel to the back of the human body, a band means affixed with the board whereby the band means is adapted to releasably secure the flat face of the board adjacent to the back of the human body, the band means being of a length sufficient that at least together with the board, the band means together with the board is able to surround the torso of the body with the board being located adjacent to the back of the human body, and at least one auxiliary buoyant element, the auxiliary buoyant element including means for permitting removable location of the auxiliary buoyant element relative to the board such that the auxiliary buoyant element in a first position can be located adjacent to the board and in a second position located removed from the board, and the overall width of the band means extending at least about 20% of the board length, and the band means being located essentially in a lower portion of the board element and not in an upper portion of the board element.

* * * * *

UNITED STATES PATENT AND TRADEMARK OFFICE

CERTIFICATE OF CORRECTION

PATENT NO. : 5,472,391

DATED : December 5, 1995

INVENTOR(S) : Weissbuch

It is certified that error appears in the above-identified patent and that said Letters Patent is hereby corrected as shown below:

Column 6, line 28: insert --31-- after the word "strips".
Column 9, line 13: insert --.-- after the numeral "109".

Signed and Sealed this

Thirtieth Day of April, 1996

Bruce Lehman

*Attest:*

BRUCE LEHMAN

*Attesting Officer*

*Commissioner of Patents and Trademarks*